US012551779B1

(12) United States Patent
Russo, Sr.

(10) Patent No.: US 12,551,779 B1
(45) Date of Patent: Feb. 17, 2026

(54) ADAPTIVE CHECKER GAME PIECE WITH GRIPPING LEAF

(71) Applicant: Michael F. Russo, Sr., Everett, MA (US)

(72) Inventor: Michael F. Russo, Sr., Everett, MA (US)

( * ) Notice: Subject to any disclaimer, the term of this patent is extended or adjusted under 35 U.S.C. 154(b) by 0 days.

(21) Appl. No.: 19/294,046

(22) Filed: Aug. 7, 2025

(51) Int. Cl.
*A63F 3/00* (2006.01)

(52) U.S. Cl.
CPC ..... *A63F 3/00895* (2013.01); *A63F 3/00697* (2013.01); *A63F 2003/00719* (2013.01); *A63F 2003/00899* (2013.01); *A63F 2250/485* (2013.01)

(58) Field of Classification Search
CPC ..... A63F 3/00697; A63F 2003/007; A63F 2003/00703; A63F 2003/00719; A63F 2003/00747; A63F 2003/00753; A63F 2003/00757; A63F 2003/00801; A63F 2003/00899; A63F 2250/485
USPC ..... 273/239, 260, 271, 288, 289, 290
See application file for complete search history.

(56) References Cited

U.S. PATENT DOCUMENTS 72,670 A 12/1867 Nott
179,483 A * 7/1876 Lewis ..... A63F 3/00697 273/290
259,217 A 6/1882 Sanderson
437,838 A * 10/1890 Sperl ..... A63F 3/00176 273/261
477,248 A * 6/1892 Davidson ..... A63F 3/00697 273/289
714,930 A * 12/1902 Mease ..... A63F 3/00697 273/290
1,170,109 A * 2/1916 Rogers ..... A63F 3/00697 273/290
1,510,853 A 10/1924 Latz
1,595,285 A 8/1926 Bevan
1,711,469 A * 4/1929 Stratford ..... G09F 23/00 215/349
2,052,797 A 9/1936 Read
(Continued)

FOREIGN PATENT DOCUMENTS

CH 675695 10/1990
CN 108525282 9/2018
(Continued)

*Primary Examiner* — Joseph B Baldori
(74) *Attorney, Agent, or Firm* — Thomas P. O'Connell; O'Connell Law Firm

(57) ABSTRACT

An adaptive checker piece for facilitating gripping and manipulation of the checker piece comprising a round main body and a gripping leaf extending therefrom. The gripping leaf forms a segment of a cone spanning an angular range α, and the gripping leaf is angled outwardly relative to a central axis of the main body at an angle β. A round upper platform projects concentrically from the main body but with a smaller diameter whereby an upper raceway is formed. The gripping leaf projects from the main body from a position laterally outward of the upper raceway. A lower toroid projects concentrically from a lower portion of the main body and is sized to receive an upper platform of a second adaptive checker piece in an interference fit. Multiple checker pieces can be stacked to make king pieces and for storage despite the presence of the gripping leaf.

20 Claims, 9 Drawing Sheets

(56) References Cited

U.S. PATENT DOCUMENTS

| | | | | | |
|---|---|---|---|---|---|
| 2,418,287 | A | | 4/1947 | Bennett | |
| 2,534,055 | A | * | 12/1950 | Peterson | A63F 3/00697 273/290 |
| 3,186,716 | A | | 6/1965 | Shabarick | |
| 3,319,961 | A | * | 5/1967 | Wilson | A63F 3/00697 206/226 |
| 3,520,537 | A | * | 7/1970 | Peebles | A63F 3/00697 273/290 |
| 3,531,122 | A | | 9/1970 | Peebles | |
| 3,531,123 | A | * | 9/1970 | Peebles | A63F 3/00697 273/290 |
| 3,602,514 | A | * | 8/1971 | Peebles | A63F 3/00574 273/290 |
| 3,610,627 | A | * | 10/1971 | Peebles | A63F 3/00574 273/290 |
| 3,680,865 | A | * | 8/1972 | Davis | A63F 3/00694 273/239 |
| 3,806,128 | A | | 4/1974 | Endfield | |
| D234,211 | S | | 1/1975 | Stubbmann | |
| 3,891,217 | A | | 6/1975 | Geary | |
| 3,902,724 | A | * | 9/1975 | Hersey | A63F 3/00697 273/290 |
| 3,930,652 | A | * | 1/1976 | Lapolice | A63F 3/00697 273/288 |
| 3,975,020 | A | * | 8/1976 | Vogel | A63F 3/00697 273/DIG. 8 |
| 3,984,110 | A | | 10/1976 | Eckert | |
| 4,025,076 | A | | 5/1977 | Lipps | |
| 4,032,152 | A | * | 6/1977 | Schifman | A63F 3/00697 273/258 |
| 4,326,720 | A | | 4/1982 | Erlich | |
| 4,343,476 | A | | 8/1982 | Engel | |
| 4,478,417 | A | | 10/1984 | Shamsid-Deen | |
| 4,497,491 | A | * | 2/1985 | Holman | A63F 3/00094 273/271 |
| 4,603,863 | A | | 8/1986 | Meyer | |
| 4,805,915 | A | * | 2/1989 | Lamle | A63F 3/00697 273/261 |
| 4,961,583 | A | | 10/1990 | Koch | |
| 5,312,110 | A | * | 5/1994 | Youwanes | A63F 3/00697 273/237 |
| 5,472,208 | A | | 12/1995 | Berry | |
| D384,113 | S | * | 9/1997 | Subers | D21/390 |
| 5,690,333 | A | * | 11/1997 | Danner | A63F 3/02 273/242 |
| 5,839,727 | A | * | 11/1998 | Stillinger | A63F 3/00697 273/271 |
| 6,726,206 | B2 | * | 4/2004 | Brown | A63F 3/02 273/287 |
| 7,731,194 | B2 | | 6/2010 | Ishihara | |
| D1,013,048 | S | | 1/2024 | Collard | |
| 2001/0050461 | A1 | | 12/2001 | Tarbell | |
| 2006/0131806 | A1 | | 6/2006 | Kenney | |
| 2007/0045952 | A1 | | 3/2007 | Jones | |
| 2008/0315518 | A1 | * | 12/2008 | Kuo | A63F 3/00697 273/241 |
| 2018/0326296 | A1 | | 11/2018 | Hanses | |
| 2024/0390778 | A1 | | 11/2024 | Franken | |

FOREIGN PATENT DOCUMENTS

| | | |
|---|---|---|
| CN | 210933720 | 7/2020 |
| CN | 112451956 | 3/2021 |
| GB | 181632 | 6/1922 |
| GB | 2269111 | 2/1994 |

* cited by examiner

ADAPTIVE CHECKER GAME PIECE WITH GRIPPING LEAF

FIELD OF THE INVENTION

The present invention relates generally to game pieces. More particularly, disclosed herein is an adaptive checker game piece with a gripping leaf and a checker game set incorporating such game pieces.

BACKGROUND OF THE INVENTION

The game of checkers can trace its origins to ancient times. Checkerboards with their pieces were found in ancient Egyption burial chambers. Plato and Homer each mention similar games, and stories are told of checker-type games being played during the Trojan War. In such games, capture was accomplished by placing two pieces on either side of an opponent's piece. The rule of crowning is believed to have been developed in the 13th century. Numerous variants of the game of checkers have been developed over time.

In modern times, the game of American checkers, alternatively referred to as straight checkers, or English draughts in the United Kingdom is commonly played on boards of 8λ8 or 10λ10 squares between two opponents sitting on opposite sides of the game board. The checkerboard has alternating light and dark squares disposed in a staggered format. One player has dark game pieces while the other has lighter colored game pieces, and the players take alternating turns moving his or her game pieces diagonally into unoccupied squares. When an adjacent diagonal square in the player's forward direction is occupied by an opponent's piece and the square immediately beyond is vacant, the opponent's game piece can be captured by jumping one's game piece over it.

A game piece can make successive jumps in a single turn so long as each jump captures an enemy piece. When a player's game piece reaches the farthest row forward, often know as the king's row or crown head, that piece becomes a king and is marked by crowning where another game piece is stacked atop it. While other game pieces are limited in their movement, the king can move any number of squares at a time and can move and capture backwards. Captured pieces are removed from the game board. Once a player has no valid moves remaining, such as where he or she has no more game pieces or where all of the player's pieces are obstructed from moving by opponent pieces, he or she loses the game.

Checker pieces typically comprise small, flat disk-shaped tokens of approximately one to one and one-half inches in diameter and roughly one-quarter of an inch thick. They can be made from nearly any material, including plastic, wood, or any other suitable material or combination of materials. Traditional checker pieces often have smooth outer annular surfaces, and they commonly have features to enable their stacking, such as for making checker kings and for storage and transport. The pieces within a given set are normally uniform in size and shape.

Being able to play and enjoy checkers relies, of course, on a player's ability to grip and manipulate the game pieces comfortably and accurately, but it will be recognized that doing so requires a minimum degree of dexterity. For persons with unimpeded use of their hands and fingers, accurately and comfortably gripping, moving, and otherwise manipulating individual checkers is a relatively simple task despite the relatively small size and low profile of the checker pieces and the smooth round sides thereof.

However, many individuals lack the ability to grip and manipulate a standard checker piece with comfort and the required dexterity. For instance, persons with arthritis may struggle to lift and position a checker piece without pain. Likewise, elderly players and other individuals with limited or diminished motor skills may lack the dexterity needed to grip and move pieces with speed and precision. Very unfortunately, many such persons will forego playing what would otherwise be an enjoyable game as a result of their limited ability to grip and manipulate standard checker pieces.

The real need for an improved checker piece that could be readily gripped and moved even by persons with limited dexterity has been recognized. For instance, with U.S. Patent Application Publication No. 2024/0390778, Thomas David Franken, Jr. disclosed what he referred to as Easy Grip Checker Pieces. Those checker pieces are designed with top portions larger than the base portions thereof to enable "a player to reach under the top of the piece and lift it up." The checker pieces also have "an indent in the top or various things sticking up to both help grip the piece and help keep the pieces stacked if the player shakes as they are picking the pieces up." In at least one embodiment, those 'things' comprise "some 'Jewels' added to help with stacking and making [the piece] easier to grip." Disadvantageously, however, those same jewels could become dislodged and present their own hazards. Moreover, they do little to assist a player as he or she tries to grip one piece, still with a low profile, in relation to multiple adjacent pieces. In many respects, even this improved checker piece retains many of the disadvantages presented by prior art checker pieces.

In view of the foregoing, it is apparent that there remains a need for improved game pieces for board games, such as checkers or draughts, that can be readily and comfortably gripped and manipulated even by persons with limited or diminished motor skills, strength, and dexterity.

SUMMARY OF THE INVENTION

With an appreciation of the foregoing limitations of the prior art and the challenges presented by, for instance, checker game pieces of the past, the present invention is founded on the basic object of providing an adaptive game piece that permits individuals, including those with limited or diminished motor skills, strength, and dexterity, to grip, move, and place the same with relative ease and comfort.

A further object of embodiments of the invention is to provide such an adaptive game piece that enables such gripping and manipulation capabilities while remaining strong and durable in construction.

An additional object of embodiments of the invention is to provide such an adaptive game piece that nonetheless enables multiple game pieces to be stably stacked, such as to make king game pieces and for storage and transport.

The foregoing and further objects, advantages, and details of manifestations of the present invention will become obvious not only to one who reviews the present specification and drawings but also to those who have an opportunity to experience an embodiment of the adaptive game piece and a game set incorporating such game pieces disclosed herein in operation. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more objects of the invention, an embodiment of the adaptive checker piece for facilitating gripping and manipulation of the checker piece is founded on a main body with an upper portion, a lower portion, and a peripheral edge between the upper and lower portions of the main body. A gripping leaf has a proximal portion fixed to the main body and a distal portion that extends from the main body. Under this structure, the adaptive checker piece can be gripped, lifted, and moved by a gripping of the gripping leaf.

In certain embodiments, the gripping leaf comprises an arcuate wall that forms a segment of a cone. Where the main body is substantially round with a central axis, the arcuate wall is preferably substantially concentric with the main body. In preferred embodiments, the gripping leaf spans an angular range $\alpha$ of between forty-five and ninety degrees, most preferably approximately eighty degrees. Moreover, to promote the ability a player to grip the gripping leaf conveniently while permitting multiple checker pieces to be stacked, the gripping leaf is angled outwardly relative to the central axis at an angle $\beta$ from the proximal portion to the distal portion of the gripping leaf. The angle $\beta$ is preferably between approximately ten and twenty degrees and most preferably approximately fifteen degrees, which has been found to facilitate gripping while further contributing to the ability of the checker pieces to be stacked in a nesting relationship.

Embodiments of the adaptive checker further comprise an upper platform that projects from the upper portion of the main body. The upper platform is narrower in lateral dimension, such as in diameter, relative to the main body. With that, an upper raceway is formed by a surface of the upper portion that projects laterally beyond the upper platform. Ideally, the gripping leaf projects from the main body laterally outwardly of the upper raceway formed by the surface of the upper portion that projects laterally beyond the upper platform thereby further enabling a stacking of adaptive game pieces, such as for making king pieces and for storage. Where the main body and the upper platform are substantially round and concentric about a central axis, the upper raceway is annular.

Further, embodiments of the adaptive checker piece comprise a lower toroid that projects from a lower portion of the main body concentrically with the central axis and thus with the main body and the upper platform. The lower toroid has an inner diameter sized relative to the outer diameter of the upper platform such that the upper platform of one adaptive checker piece can be matingly received within the inner diameter of the lower toroid of a second adaptive checker piece. Even more preferably, the inner diameter of the lower toroid and the outer diameter of the upper platform are relatively sized such that an interference fit is established when the upper platform of one adaptive checker piece is matingly received within the inner diameter of the lower toroid of a second adaptive checker piece. With that, a frictional engagement of pieces can be achieved, whether during the creation of a king piece or where checker pieces are stacked for sale or storage.

In practice, an adaptive checker game set is formed comprising a checker game board and a plurality of adaptive checker pieces as disclosed herein. For instance, the checker game set can include a plurality of adaptive checker pieces as taught herein formed in a first color, such as black, and a plurality of adaptive checker pieces pursuant to the invention formed in a second color, such as red, different than the first color.

One will appreciate that the foregoing discussion broadly outlines certain goals and features of non-limiting embodiments of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

The present invention will be described and explained with additional specificity and detail through reference to the accompanying drawings wherein.

DETAILED DESCRIPTION OF PREFERRED EMBODIMENTS

The present invention for an adaptive game piece and a game set incorporating such game pieces could pursue widely varied embodiments. However, to ensure that one skilled in the art will be able to understand and, in appropriate cases, practice the invention, certain preferred embodiments of the broader invention revealed herein are described below and shown in the accompanying drawing figures. These embodiments are intended to be illustrative but are not intended to be limiting in any manner.

Turning more particularly to the drawings, an embodiment of the adaptive checker piece disclosed herein is indicated generally at 10 in FIGS. 1 through 10. There, one can perceive that the checker piece 10 is founded on a disk-shaped main body 12, which can be solid in material. As such, the main body 12 is generally round with a given thickness with an upper portion and a lower portion. The main body 12 has a peripheral edge that is smooth.

Figure 3:
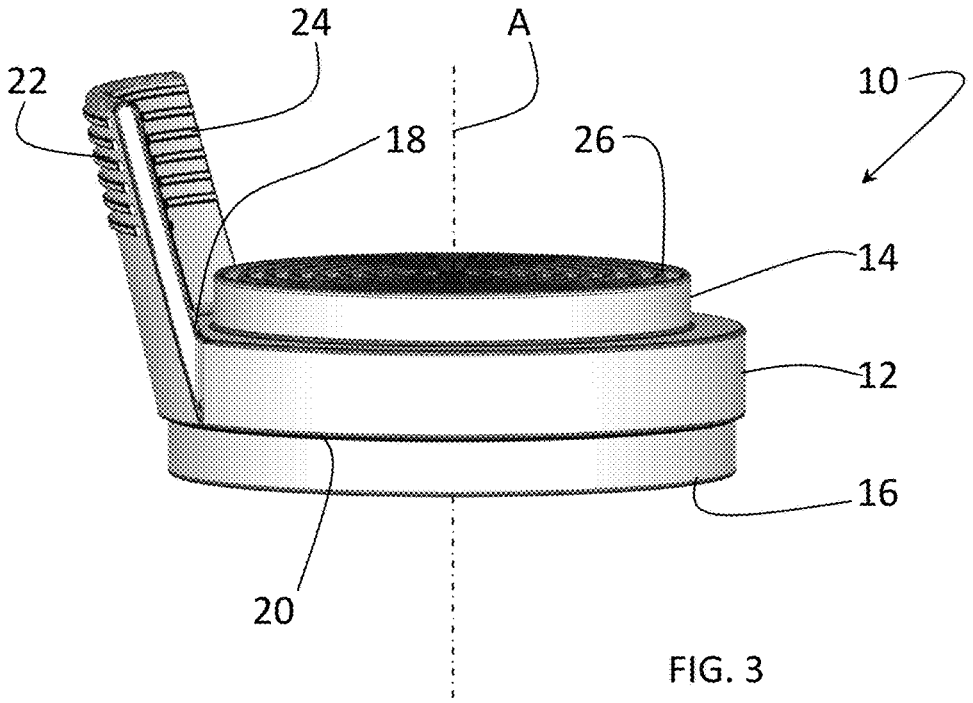
FIG. 3 is an upper right lateral perspective view of the adaptive checker piece.
Figure 4:
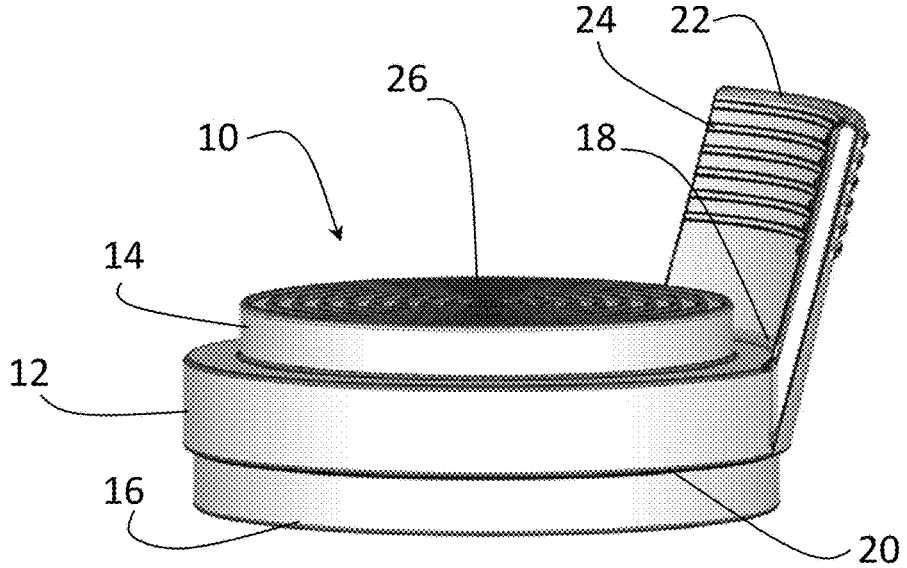
FIG. 4 is an upper left lateral perspective view of the adaptive checker piece.
Figure 5:
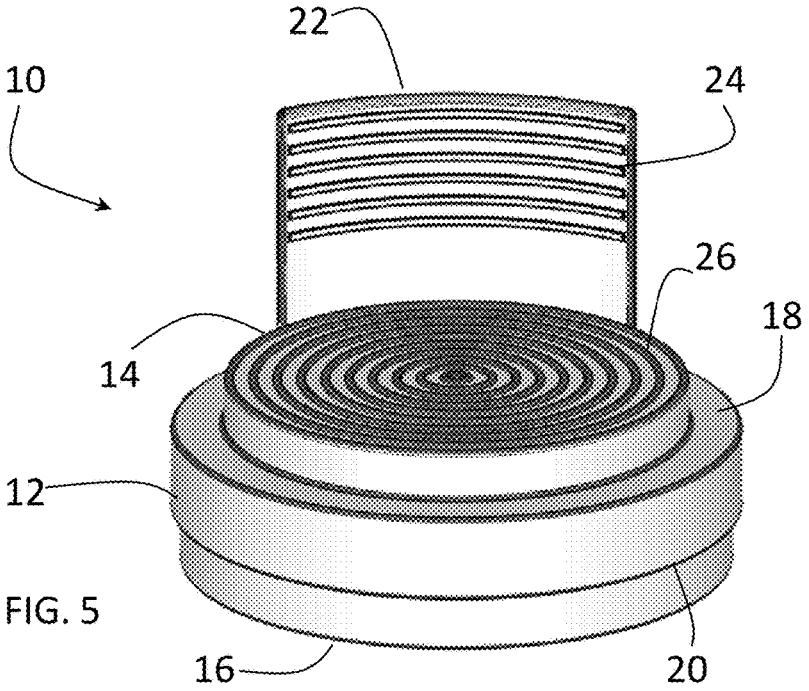
FIG. 5 is an upper anterior perspective view of the adaptive checker piece.
Figure 6:
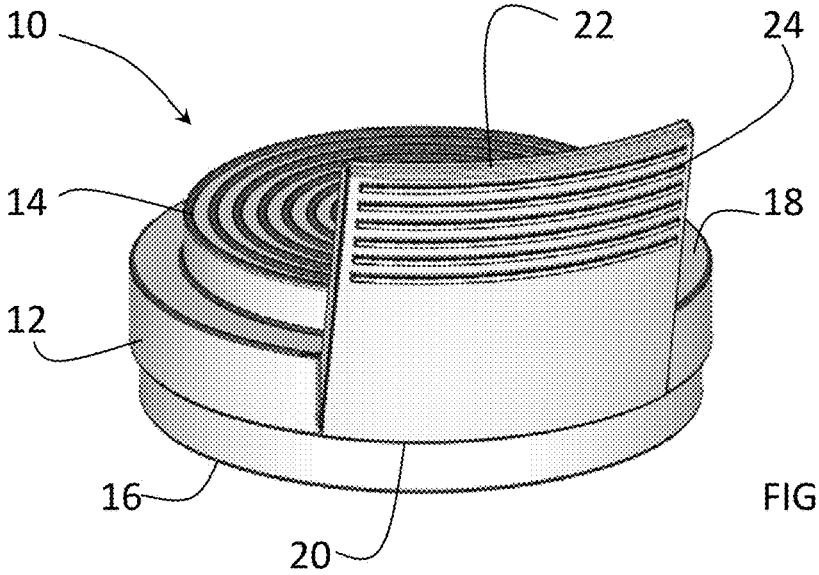
FIG. 6 is a lower posterior perspective view of the adaptive checker piece.

An upper platform 14 projects upwardly from the main body 12 and is likewise disk-shaped such that the upper platform 14 is generally round with a given thickness with a lower portion fixed to the main body 12, such as by integral formation or otherwise, and an upper portion forming an upper surface of the upper platform 14. With particular reference to FIG. 3, the upper platform 14, which can be solid in material, can be seen to be concentric with the main body 12 with respect to a central axis A of the checker piece 10. The upper platform 14 has a smaller outer diameter than that of the main body 12 such that an upper shoulder or raceway 18 is formed by an annular upper surface portion of the main body 12 that extends laterally beyond the upper platform 14. The upper raceway 18 has a width equal to one-half of the difference of the diameter of the upper platform 14 as compared to the diameter of the main body 12.

A lower toroid 16 projects downwardly from the main body 12. The lower toroid 16 can likewise be formed integrally with the main body 12. The lower toroid 16 is formed concentrically with the main body 12 but with a reduced outer diameter. As such, a lower shoulder 20 is formed by an annular lower surface portion of the main body 12 that extends beyond the annular outer surface of the lower toroid 16. The lower shoulder 20 has a width equal to one-half of the difference between the outer diameter of the lower toroid 16 and the outer diameter of the main body 12. The outer diameter of the upper platform 14 is smaller than the outer diameter of the lower toroid 16 such that the upper shoulder or raceway 18 is greater in width than the lower shoulder 20.

The outer diameter of the upper platform 14 and the inner diameter of the lower toroid 16 are relatively sized such that the upper platform 14 of one adaptive checker piece 10 can be matingly received within the inner diameter of the lower toroid 16 of a second adaptive checker piece 10. In preferred embodiments, the upper platform 14 and the lower toroid 16 are relatively sized so that a slight interference fit is established. Under such constructions, adaptive checker pieces 10 according to the present invention can be stacked and temporarily joined, such as to make a king game piece or for sale, storage, and transport.

A gripping leaf 22 extends from the main body 12 of the adaptive checker piece 10 for enabling comfortable lifting, manipulation, and placement of the checker piece 10 on a game board. In the present embodiment, the gripping leaf 22 is formed as an arcuate wall forming a segment of a cone, alternatively referred to as a frustoconical segment, concentric with the central axis A and thus with the main body 12, the upper platform 14, and the lower toroid 16. The gripping leaf is arcuate in lateral cross section.

Figure 7:
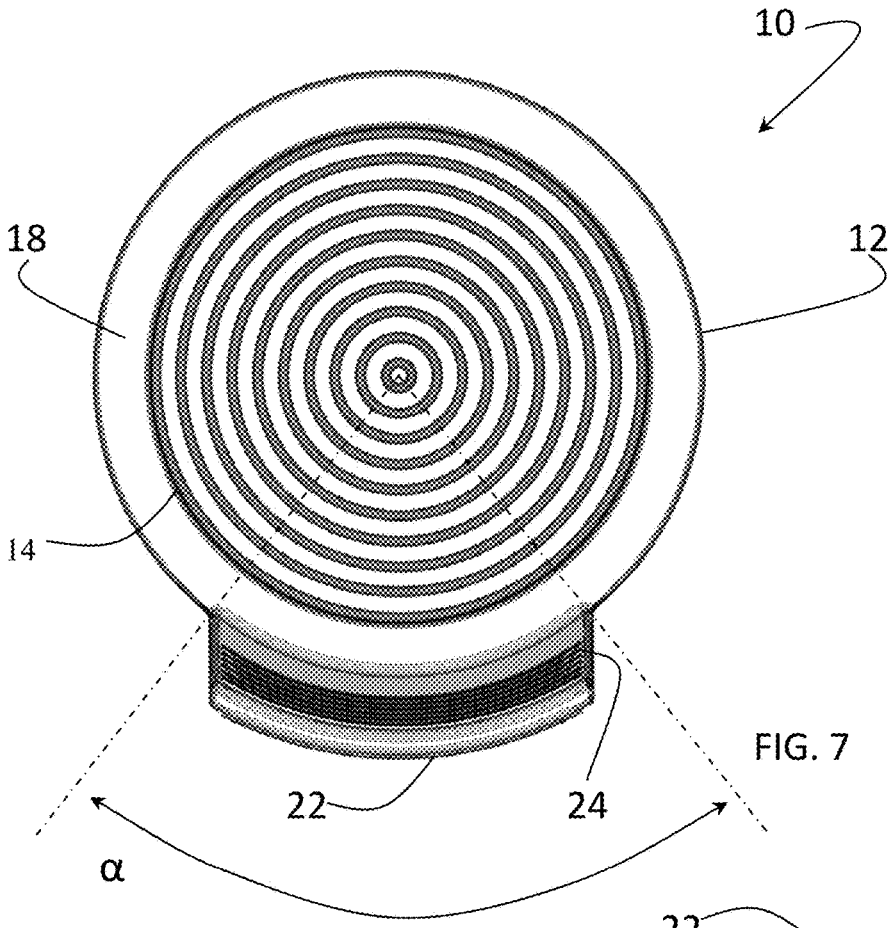
FIG. 7 is a top plan view of the adaptive checker piece.
Figure 8:
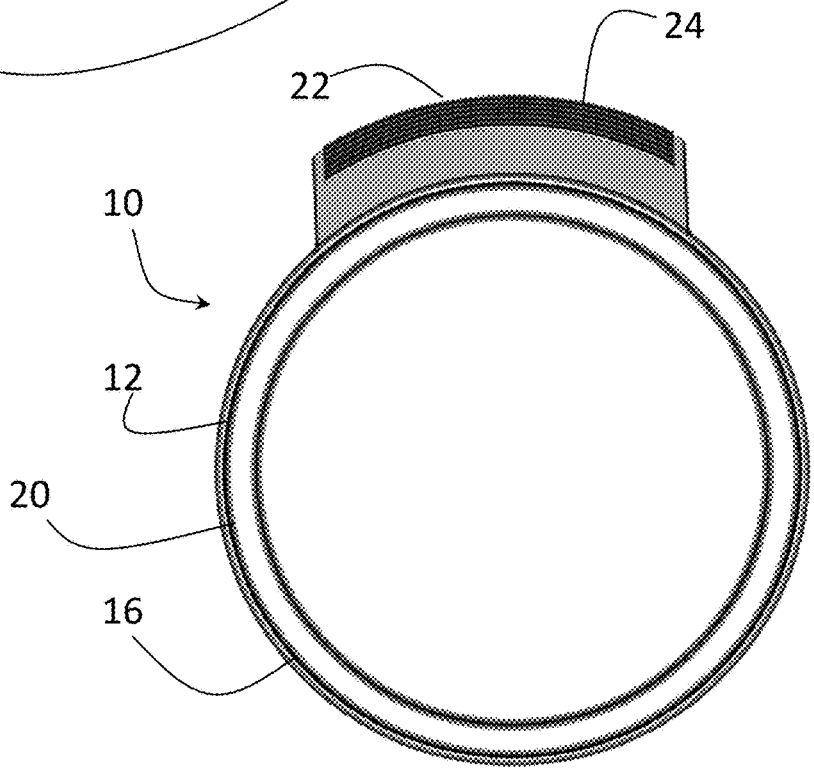
FIG. 8 is a bottom plan view of the adaptive checker piece.

As may be best seen in the plan views of FIGS. 7 and 8, the gripping leaf 22 spans an angular range $\alpha$. In the present embodiment, that angular range $\alpha$ is preferably between approximately forty-five and ninety degrees and more preferably approximately eighty degrees, but it will be understood that other angular ranges are possible and within the scope of the invention.

Figure 9:
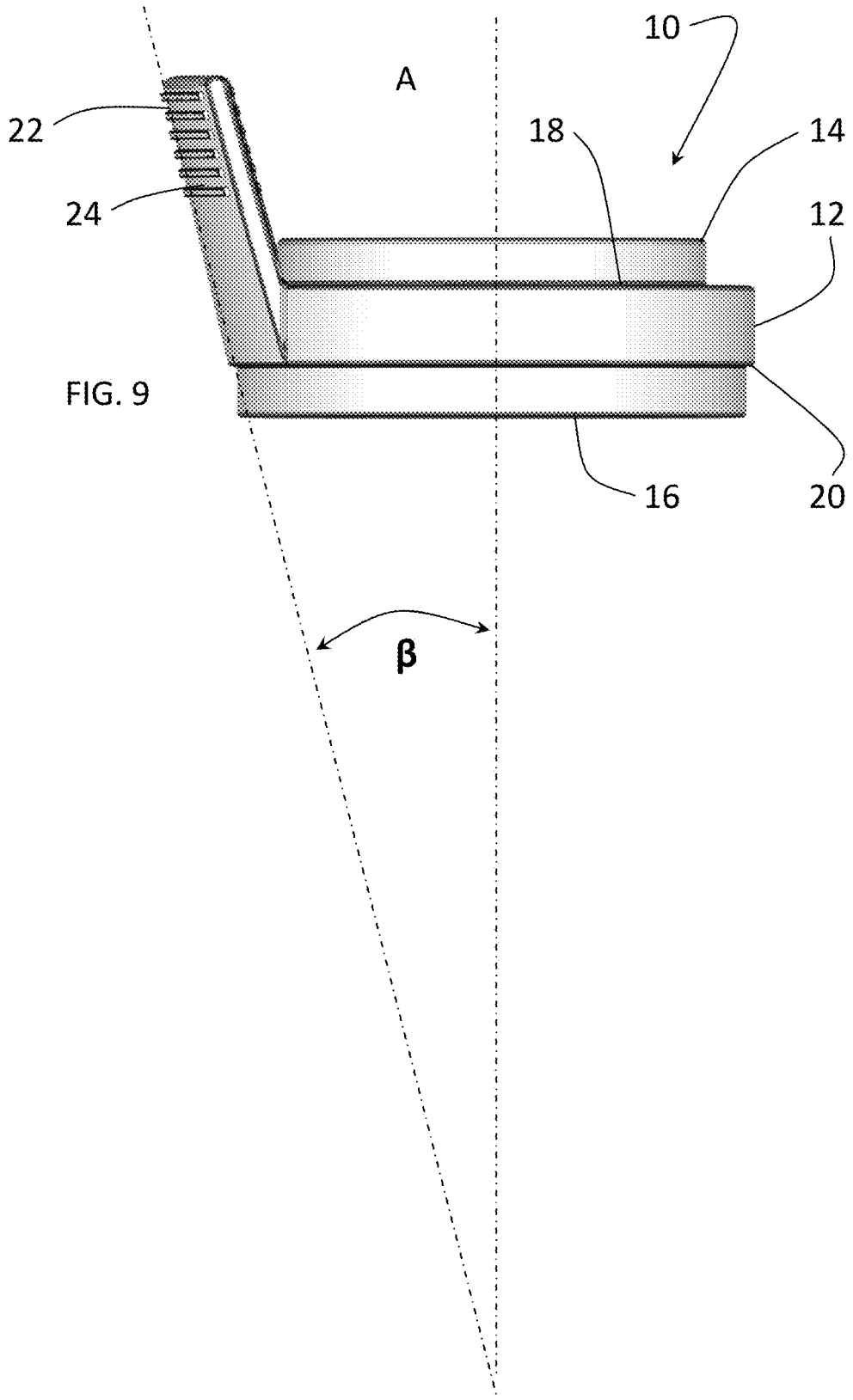
FIG. 9 is a right side elevation of the adaptive checker piece.
Figure 10:
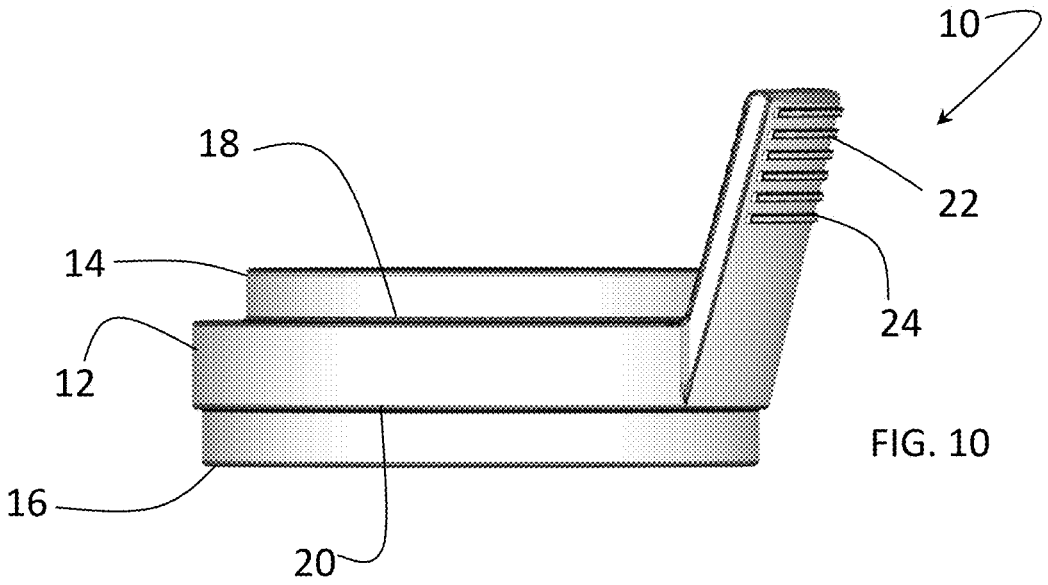
FIG. 10 is a left side elevation view of the adaptive checker piece.

As is illustrated in FIG. 9, the gripping leaf 22 is angled outwardly relative to the central axis A at an angle $\beta$ from its proximal end, which is fixedly joined with the main body 12 as by integral formation or otherwise, to its distal end, which is free for gripping by a player. In the depicted embodiment, the arcuate wall defining the gripping leaf 22 extends at an angle $\beta$ relative to the central axis A. Preferably, the angle $\beta$ is between approximately ten and twenty degrees. In the present example, the angle $\beta$ is approximately fifteen degrees, but it will again be understood that other angles are within the scope of the invention except as may be expressly limited by the claims. In any case, it is also preferable that the gripping leaf 22 projects outwardly at an angle $\beta$ sufficient to cause the inner surface of the gripping leaf 22 of a lower checker piece 10 to be disposed laterally outward of the outer surface of the gripping leaf 22 of an upper checker piece 10 when the pieces 10 are engaged with the upper platform 14 of the lower checker piece 10 received into the lower toroid 16 of the upper checker piece 10.

Looking again to FIG. 7, it will be noted that, by projecting from the main body 12 of the checker piece, the gripping leaf 22, including inner surface thereof at the base of the gripping leaf 22, is disposed laterally outward of the upper raceway 18. With that, the upper raceway 18 forms a continuous wing of a substantially consistent width surrounding the upper platform 14. Under this construction, the lower toroid 16 of an upper adaptive checker piece 10 can be received into the upper raceway 18 of a lower adaptive checker piece 10 with the upper platform 14 of the lower checker piece 10 received into the lower toroid 16 of the upper checker piece 10.

Based on its arcuate shape as a segment of a cone or frustoconical segment, based on its spanning of the angular range $\alpha$ between approximately forty-five and ninety degrees and preferably approximately eighty degrees, and based on its being angled outwardly relative to the central axis A at an angle $\beta$ between approximately ten and twenty degrees and preferably at approximately fifteen degrees, the gripping leaf 22 forms an ideal structure for permitting a lifting and manipulation of the adaptive game piece 10. Each of the shape, disposition, and angular ranges and dispositions contributes on its own to the effectiveness and convenience of grasping the gripping leaf 22, but those aspects also work together in a synergy that markedly differentiates from the known prior art. As formed and disposed, the gripping leaf 22 comprises a readily accessible, comfortably gripped handle for the checker piece 10 with a shape, angular range, and orientation that permits gripping in a comfortable manner, including by applying one or more of the player's thumb or other fingers into the arcuate shape defined by the leaf 22 and easily lifting and moving the game piece 10. Moreover, with its proximal portion disposed laterally outward of the upper raceway 18, which itself surrounds the upper platform 14, and with its outward angling, multiple game pieces 10 may nonetheless be stacked and frictionally coupled in a nesting relationship.

Figure 1:
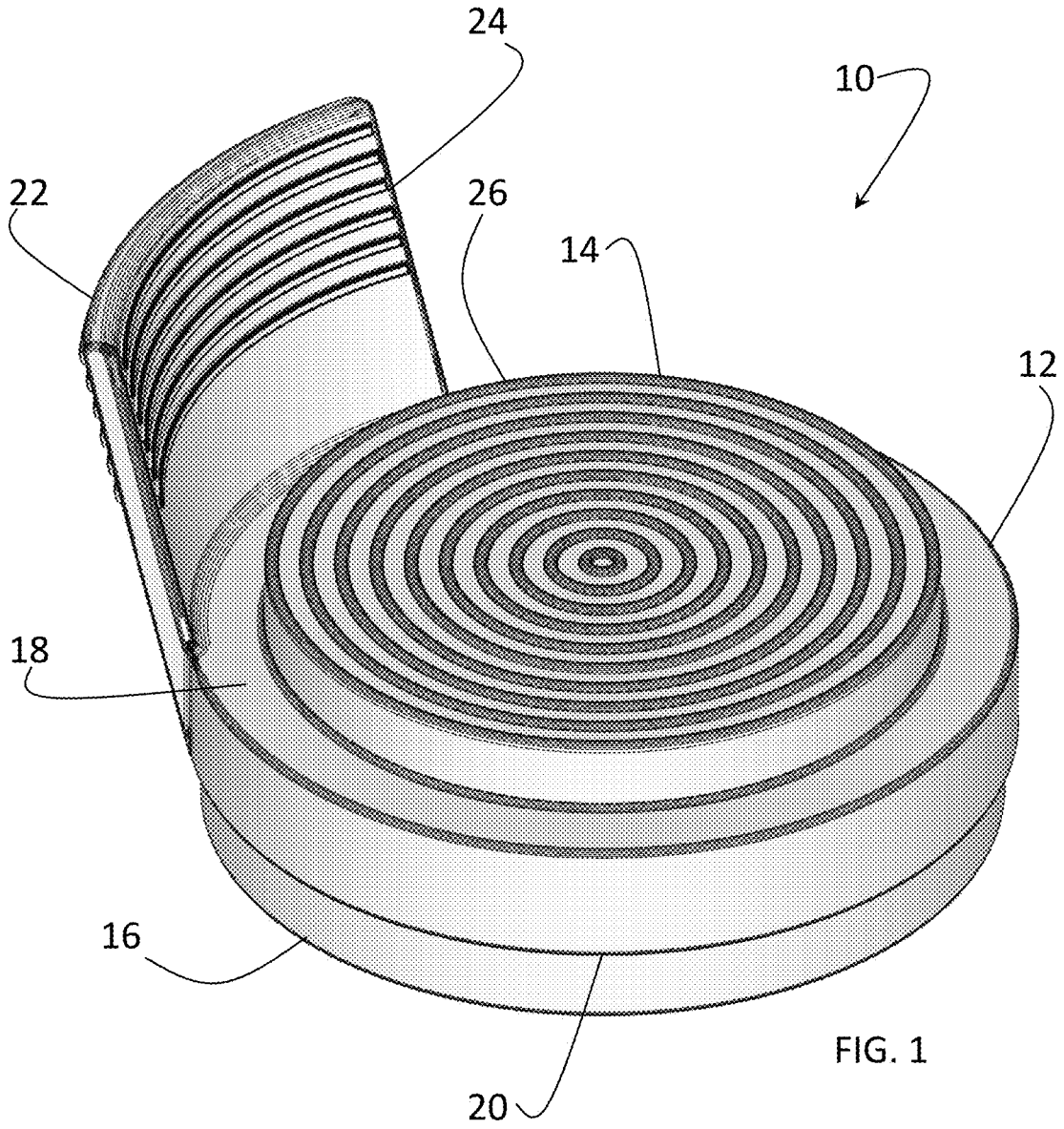
FIG. 1 is an upper perspective view of an adaptive checker piece according to the present invention.
Figure 2:
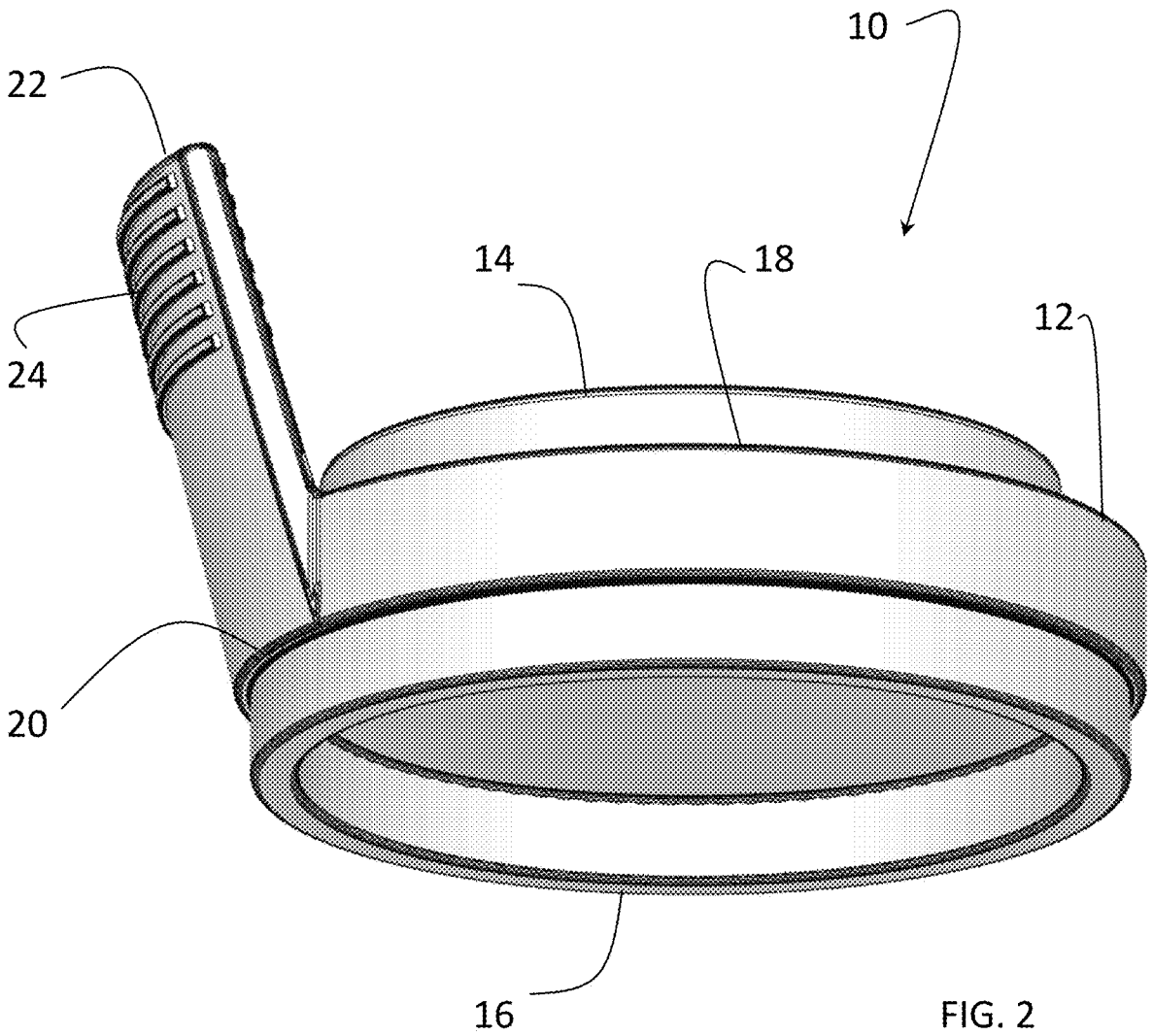
FIG. 2 is a lower perspective view of the adaptive checker piece.

As seen, for instance, in FIGS. 1 and 2, protuberating formations 24 are disposed on the inner and outer surfaces of the gripping leaf 22 to render a gripping of the gripping leaf 22 and gripping and manipulation of the checker piece 10 itself still more comfortable and effective. In the depicted example, the protuberating formations 24 comprise laterally communicating ridges, but other formations 24 are readily possible. Additionally, protuberating formations 26 are disposed on the top surface of the upper platform 14 to promote comfortable and convenient gripping of the checker piece 10 still further. As illustrated, the protuberating formations 26 could comprise annular ring formations 26, but other shapes are readily possible and within the scope of the invention.

The checker piece 10 and the components thereof, including the main body 12, the upper platform 14, the lower toroid 16, and the gripping leaf 22 can be formed of any suitable material or materials, and they can be joined in any effective manner. In contemplated embodiments, the components of the checker piece 10 are integrally formed, such as by molding, by a plastic material, but any other material or combination of materials would be readily possible and within the scope of the invention except as it may be expressly limited.

Figure 11:
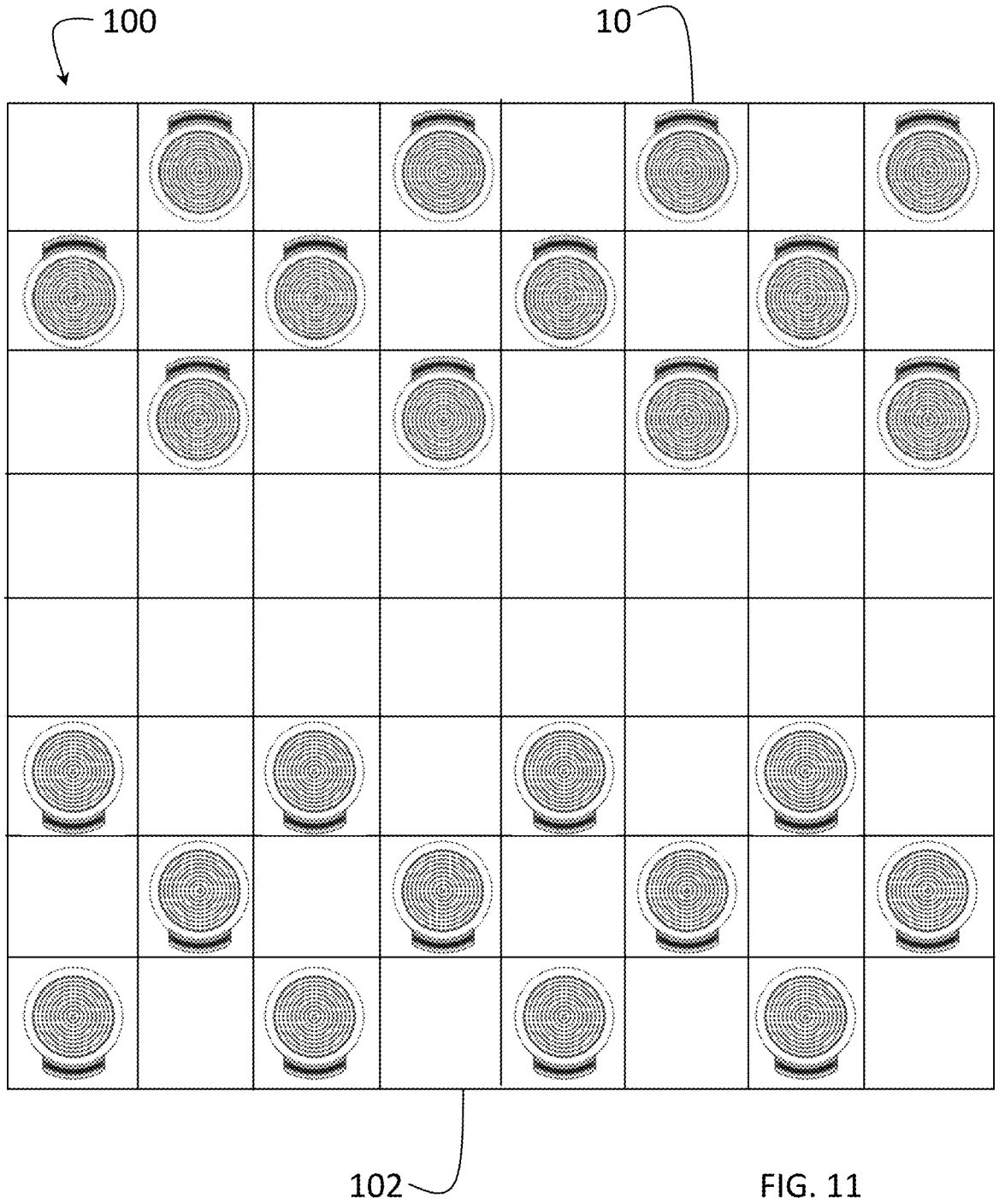
FIG. 11 is a top plan view of a checker game set incorporating adaptive checker pieces as taught herein.

Turning to FIG. 11, a checker game set 100 can be formed with a plurality of adaptive game pieces 10 in combination with a game board 102. The game board 102 will preferably have a surface divided into dark and light squares, such as in an 8λ8 or 10λ10 format, and the game pieces 10 will be included in dark and light colors in sufficient number to be arranged on the board 102 in accordance with the applicable rules of checkers, possibly together with spare pieces 10 as may be desirable. In the present embodiment, an 8λ8 game board 102 is illustrated such that subsets of twelve dark checker pieces 10 and twelve light checker pieces 10, again plus any number of desired spare pieces 10, would be included within the checker game set 100.

With such a checker game set 100, American checkers, English draughts, or any variation thereof can be played in a traditional manner but with players, even those with limited or reduced dexterity, being able to grip, lift, place, and otherwise manipulate individual adaptive checker pieces 10 by grasping the gripping leaf 22 in a comfortable and convenient manner. This is, of course, in marked opposition to the discomfort and other challenges that many players with dexterity limitations experience when attempting to lift, move, and place traditional checker pieces comprising low-profile, smooth-sided disks that can be so difficult to manipulate that some users may forego playing a game that would otherwise bring them entertainment and joy. Adaptive game pieces 10 can thus be readily caused to jump other game pieces 10 and to move about the board with ease.

Figure 12:
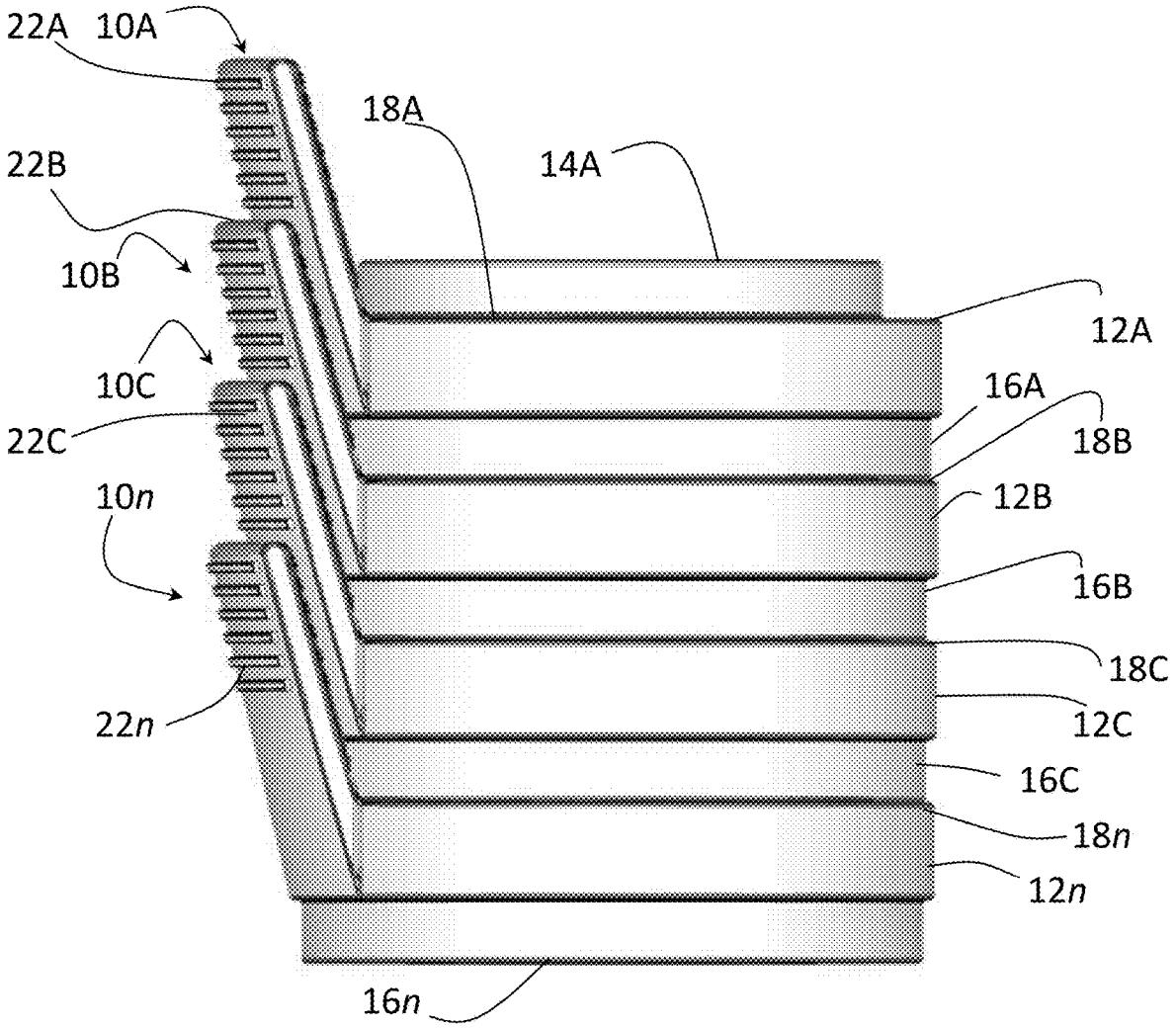
FIG. 12 is a view in right side elevation of a plurality of adaptive checker pieces according to the present invention in a stacked, nesting relationship.

Furthermore, as is illustrated in FIG. 12, despite the presence of the gripping leaf 22, two or more game pieces 10 can be readily stacked, whether in a crowning maneuver where a first adaptive game piece 10A is stacked atop a second game piece 10B to make a king game piece or where a larger multiplicity of game pieces 10A, 10B, 10C, . . . 10*n* are stacked as may be desirable upon initial manufacture and sale of the checker game set 100 or when the set 100 is to be stored. Advantageously, the game pieces 10A, 10B, 10C, . . . 10*n* can be tightly nested and removably retained together with the upper platform 14 of each lower piece 10 being matingly received and frictionally engaged by the lower toroid 16 of the adaptive game piece 10 immediately thereabove.

With certain details and embodiments of the present invention for an adaptive game piece 10 and for a game set 100 incorporating such game pieces 10 disclosed, it will be appreciated by one skilled in the art that numerous changes and additions could be made thereto without deviating from the spirit or scope of the present invention. This is particularly true when one bears in mind that the presented preferred embodiments merely exemplify the broader invention revealed herein. Accordingly, it will be clear that those with major features in mind could craft embodiments that incorporate those major features while not incorporating all of the features included in the preferred embodiments.

Therefore, the following patent claims shall define the scope of protection to be afforded to the invention. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, any such claims shall be construed to cover not only the corresponding structure and material expressly described in this specification but also all legally-cognizable equivalents thereof.

I claim:

1. An adaptive checker piece for facilitating gripping and manipulation of the checker piece, the checker piece comprising:

a main body with an upper portion, a lower portion, and a peripheral edge between the upper and lower portions of the main body;

one gripping leaf consisting essentially of a wall, wherein the gripping leaf has a proximal portion fixed to the main body and a distal portion that extends from the main body;

an upper platform that projects from the upper portion of the main body, wherein the upper platform is narrower in lateral dimension than the main body whereby an upper raceway is formed by a surface of the upper portion that projects laterally beyond the upper platform;

wherein the one gripping leaf projects from the main body laterally outwardly of the upper raceway formed by the surface of the upper portion that projects laterally beyond the upper platform and wherein the proximal portion of the one gripping leaf is disposed laterally outward of the upper raceway formed by the surface of the upper portion that projects laterally beyond the upper platform;

whereby the adaptive checker piece can be gripped, lifted, and moved by a gripping of the gripping leaf.

2. The adaptive checker piece of claim 1, wherein the wall of the one gripping leaf is arcuate in lateral cross section.

3. The adaptive checker piece of claim 2, wherein the arcuate wall of the one gripping leaf forms a segment of a cone.

4. The adaptive checker piece of claim 3, wherein the main body is substantially round with a central axis and wherein the arcuate wall of the one gripping leaf is substantially concentric with the main body.

5. The adaptive checker piece of claim 4, wherein the one gripping leaf spans an angular range α of between forty-five and ninety degrees.

6. The adaptive checker piece of claim 5, wherein the angular range α that the gripping leaf spans is eighty degrees.

7. The adaptive checker piece of claim 1, wherein the main body is substantially round with a central axis and wherein the one gripping leaf is angled outwardly relative to the central axis at an angle β from the proximal portion to the distal portion of the one gripping leaf.

8. The adaptive checker piece of claim 7, wherein the angle β at which the one gripping leaf is angled outwardly relative to the central axis is between ten and twenty degrees.

9. The adaptive checker piece of claim 1, wherein the main body and the upper platform are substantially round and concentric about a central axis whereby the upper raceway is annular.

10. The adaptive checker piece of claim 9, wherein the wall of the one gripping leaf is arcuate in lateral cross section.

11. The adaptive checker piece of claim 10, wherein the arcuate wall of the one gripping leaf forms a segment of a cone.

12. The adaptive checker piece of claim 11, wherein the one gripping leaf is angled outwardly relative to the central axis at an angle β from the proximal portion to the distal portion of the one gripping leaf.

13. The adaptive checker piece of claim 12, wherein the angle β at which the gripping leaf is angled outwardly relative to the central axis is between ten and twenty degrees.

14. The adaptive checker piece of claim 9, wherein the adaptive checker further comprises a lower toroid that projects from the lower portion of the main body, wherein the lower toroid is concentric with the central axis.

15. The adaptive checker piece of claim 14, wherein the lower toroid has an inner diameter, wherein the upper platform has an outer diameter, and wherein the inner diameter of the lower toroid and the outer diameter of the upper platform are relatively sized such that the upper platform of one adaptive checker piece can be matingly received within the inner diameter of the lower toroid of a second adaptive checker piece.

16. The adaptive checker piece of claim 15, wherein the inner diameter of the lower toroid and the outer diameter of the upper platform are relatively sized such that an interference fit is established when the upper platform of one adaptive checker piece is matingly received within the inner diameter of the lower toroid of a second adaptive checker piece.

17. An adaptive checker game set comprising a checker game board, a plurality of adaptive checker pieces according to claim 1 formed in a first color, and a plurality of adaptive checker pieces according to claim 1 formed in a second color different than the first color.

18. An adaptive checker piece for facilitating gripping and manipulation of the checker piece, the checker piece comprising:

a main body with an upper portion, a lower portion, and a peripheral edge between the upper and lower portions of the main body;

a gripping leaf, wherein the gripping leaf has a proximal portion fixed to the main body and a distal portion that extends from the main body;

an upper platform that projects from the upper portion of the main body, wherein the upper platform is narrower in lateral dimension than the main body whereby an upper raceway is formed by a surface of the upper portion that projects laterally beyond the upper platform;

wherein the gripping leaf projects from the main body laterally outwardly of the upper raceway formed by the surface of the upper portion that projects laterally beyond the upper platform and wherein the proximal portion of the gripping leaf is disposed laterally outward of the upper raceway formed by the surface of the upper portion that projects laterally beyond the upper platform;

whereby the adaptive checker piece can be gripped, lifted, and moved by a gripping of the gripping leaf.

19. An adaptive checker game set comprising a checker game board, a plurality of adaptive checker pieces according to claim 18 formed in a first color, and a plurality of adaptive checker pieces according to claim 18 formed in a second color different than the first color.

20. The adaptive checker piece of claim 1, wherein the main body is substantially round with a central axis and wherein the one gripping leaf is angled outwardly relative to the central axis at an angle β from the proximal portion to the distal portion of the one gripping leaf.

* * * * *